US005894873A

United States Patent [19]

Weeks

[11] Patent Number: 5,894,873

[45] Date of Patent: Apr. 20, 1999

[54] APPARATUS FOR PROCESSING LOGS

[75] Inventor: Jeffrey Weeks, Belchertown, Mass.

[73] Assignee: Tiberwolf Manufacturing Corporation, Rutland, Vt.

[21] Appl. No.: 08/940,820

[22] Filed: Sep. 30, 1997

[51] Int. Cl.[6] ..... B27L 7/00

[52] U.S. Cl. ..... 144/4.6; 144/195.1; 144/367; 144/246.1; 144/248.4; 144/366

[58] Field of Search ..... 144/4.6, 193.1, 144/195.1, 366, 367, 242.1, 246.1, 248.4, 3.1

[56] References Cited

U.S. PATENT DOCUMENTS

| | | | |
|---|---|---|---|
| 325,339 | 9/1885 | Hanavan . | |
| 475,628 | 5/1892 | Stombs . | |
| 561,569 | 6/1896 | Davidson . | |
| 1,505,928 | 8/1924 | Buck et al. . | |
| 1,888,004 | 11/1932 | Macleod . | |
| 3,501,077 | 3/1970 | Wigner et al. | 226/108 |
| 3,596,691 | 8/1971 | Broadfoot | 144/193 |
| 4,078,592 | 3/1978 | Standal | 144/208 |
| 4,269,242 | 5/1981 | Smith et al. | 144/4.6 |
| 4,273,171 | 6/1981 | Spaulding, Sr. | 144/193 |
| 4,284,112 | 8/1981 | Hoskin | 144/4.6 |
| 4,303,112 | 12/1981 | Sconce | 144/193 |
| 4,334,562 | 6/1982 | Granlund | 144/193 |
| 4,573,507 | 3/1986 | Harboe | 144/193 |
| 4,609,018 | 9/1986 | Barker | 144/4.6 |
| 4,800,937 | 1/1989 | Mangus, Sr. | 144/193 |
| 4,805,676 | 2/1989 | Aikins | 144/4.6 |
| 4,830,070 | 5/1989 | Nunnery et al. | 144/193 |
| 4,869,303 | 9/1989 | Nunnery et al. | 144/193 |
| 4,901,778 | 2/1990 | Fenton | 144/230 |
| 5,022,445 | 6/1991 | Holestine | 144/193 |

FOREIGN PATENT DOCUMENTS

| | | | |
|---|---|---|---|
| 8201820 | 3/1982 | Germany | 144/4.6 |

*Primary Examiner*—W. Donald Bray
*Attorney, Agent, or Firm*—Cantor Colburn LLP

[57] ABSTRACT

Logs are cut to firewood length and split on a trailer that has a jacking foot at the trailer tongue and that defines an elongated bed for supporting the log lengthwise of the trailer. A superstructure pivotably supports a chainsaw for cutting the log, and a driven roller engages the top of the log to feed it incrementally into the cut-off saw's path. A conventional wood splitter is also incorporated in the same trailer.

10 Claims, 2 Drawing Sheets

APPARATUS FOR PROCESSING LOGS

APPARATUS FOR PROCESSING LOGS

This invention relates generally to apparatus for processing logs, and deals more particularly with a trailer capable of cutting the logs incrementally and subsequently splitting the logs for use as firewood.

BACKGROUND OF THE INVENTION

While complex log processing equipment is available to the sawmill industry for the automated handling of logs in connection with the fabrication of lumber, the need exists for a portable log processing machine capable of producing firewood at various sites to which the device can be towed in the manner of a typical log splitting trailer for example.

U.S. Pat. No. 4,269,242 shows an endless carrier for feeding logs into the path of a reciprocating guillotine type blade which severs the log into sections of firewood length. The firewood then drops into a position where a hydraulic ram can drive the log section endwise against a fixed wedge.

Another prior art U.S. Pat. No. 4,273,171 illustrates an improvement over that prior art disclosure wherein the cutting blade is provided for movement in a horizontal direction against a stop, and wherein a wedge is provided in conjunction with that cutting blade to aid in the severing of firewood length logs from the log itself.

Both of these prior art disclosures are quite complex, and require considerable maintenance to keep them operational in the field.

The purpose of the present invention is to provide a readily transportable, low maintenance trailer which not only contains a wood splitter, but which also includes means for advancing the log into a cut-off station for severing a log of any length into sections to be split by a conventional wood splitter of the type adapted to move the log against a fixed wedge. See U.S. Pat. No. 4,303,112 for a disclosure of a typical trailer mounted wood splitter. See also U.S. Pat. No. 4,800,937 which shows a somewhat more sophisticated wedge arrangement for splitting a single firewood length log section into more than two pieces.

While complex structures are available for performing the tasks for which the present apparatus has been designed, these prior art apparatus have tended to be unduly complex as mentioned previously. See for example U.S. Pat. No. 4,869,303 wherein a wood processor is disclosed for cutting a log into a series of shorter lengths, and subsequently splitting the shorter lengths into individual pieces of firewood. This processor of the '303 patent includes a carriage for receiving the log, clamps which engage the log from both sides to secure it in the carriage, and a mechanism for advancing the carriage so that the log is brought into contact with a plurality of parallel rotating saws. After the carriage has been retracted a pusher rod moves the cut log pieces along an axis onto a plurality of cradles which support the individual log sections. These cradles are tilted to dump the sections alternately into opposite sides of the direction of log movement so that they can be fed into a plurality of individual hydraulically operated log splitters.

SUMMARY OF THE INVENTION

The present invention seeks to obviate the need for complex apparatus to form a relatively simple task of severing a log to provide firewood length sections, followed by a second stage where these sections are split.

In accordance with the present invention elongated ways are provided for supporting the log so it can be moved on its axis in a downstream direction. A driven roller is provided above the ways and is adapted to be moved into contact with the log for moving it downstream on these ways. The preferred form for roller is an hourglass shaped roller of the type having teeth or other log engaging devices to provide for incremental movement of the log in the downstream direction. While one roller might be provided, two canted rollers could also be arranged depending upon the size of the logs to be handled. A driven cut off saw, in the form of a hydraulically operated chain saw is preferably provided in a superstructure that may also support the driven roller. This cut-off saw is movable in a radial plane relative the axis of movement of the log. The roller is preferably biased downwardly toward the log so that upon rotation of this roller the log will move downstream on the ways. Finally, a wood splitter station is provided downstream of the cut-off saw so that each log section as it is severed is deposited by gravity into a tray of the log splitter where that particular log section can be split. The entire structure is provided on a wheeled trailer, the tongue of which trailer supports the upstream ends of the ways upon which the log is placed for the above-described process to be performed.

BRIEF DESCRIPTIONS OF THE DRAWINGS

A more complete understanding of the invention and many of the attendant advantages thereto will be readily appreciated as the same becomes better understood by reference to the following detailed description when considered in conjunction with the accompanying drawings wherein:

FIG. 1 shows a side elevational view of an apparatus incorporating the present invention; and FIG. 2 is an end view of the apparatus shown in FIG. 1; and shows the cut-off saw in a stowed solid line position and an active broken line position.

DETAILED DESCRIPTION

Figure 1:
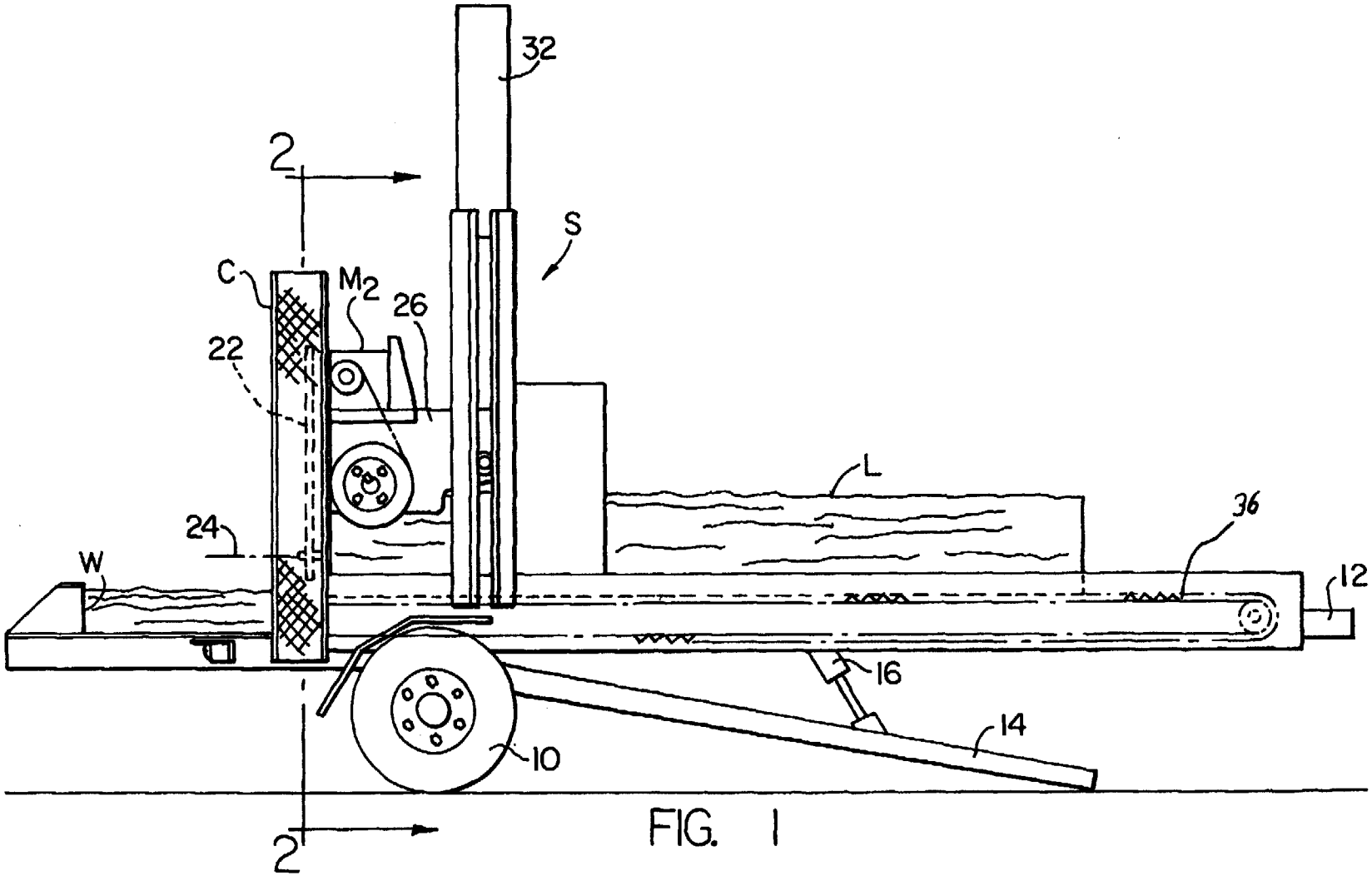

Turning now to the drawings in greater detail, the apparatus of FIG. 1 comprises a trailer having wheels 10, 10 which are supported for rotation in a frame that includes a tongue 12 which is adapted to be secured to a conventional trailer hitch (not shown) for moving the apparatus to a remote site for cutting and splitting logs into firewood length and pieces appropriate for burning in a fireplace or a woodstove.

The trailer preferably includes a downwardly movable support leg 14, which is preferably hydraulically operated as shown by the cylinder 16.

Figure 2:
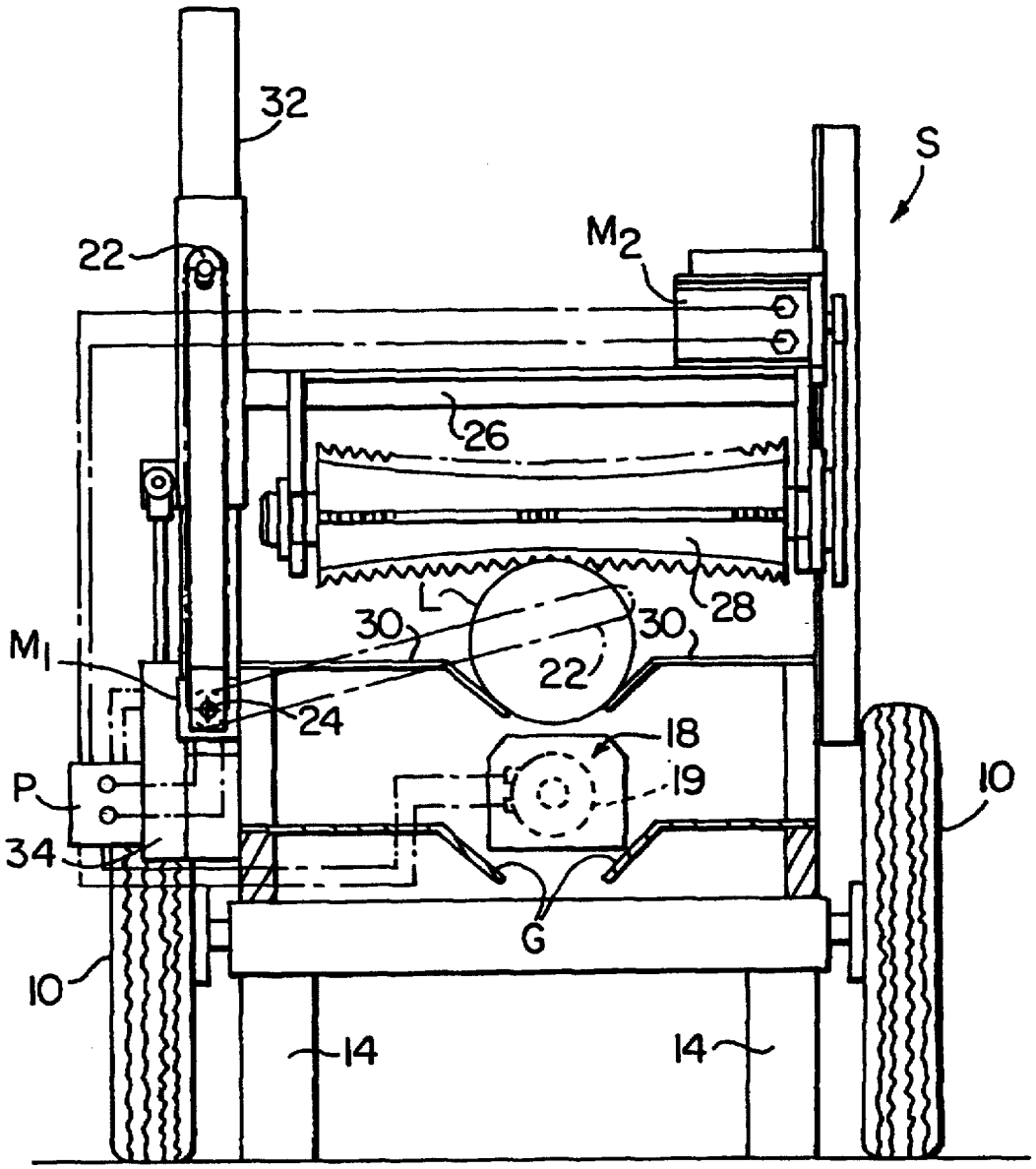

The end of the trailer opposite the tongue includes a fixed wedge W against which the fireplace length log sections can be moved by a conventionally hydraulically operated ram. The ram is best shown in FIG. 2 at 18 and the hydraulic cylinder 19 for operating same can be seen in this view as well. The fixed wedge W is adapted to split the log into a plurality of sections and may include guides G, G all in accordance with conventional practice for log splitters generally. In the frame of the trailer, preferably immediately above the axle, is provided a superstructure S that supports the two related mechanisms of the present invention in tandem one immediately behind the other. In the description to follow the downstream direction can be taken as from right to left in FIG. 1 corresponding to the direction of movement of the log L on the trailer.

Turning now to the first mechanism, a cut-off station is provided in the superstructure of FIG. 1 in the form of a chainsaw 22 which is shown in the upright position in FIG. 1 stored behind a safety cage C. The chainsaw 22 is pivotally mounted on an axis 24 defined in the frame of the machine for movement between the position shown into the path of the log to a generally horizontal position such that a log section of desired length can be separated from the log. A hydraulic motor $M_1$ is selectively driven from the control panel P.

Immediately behind the cut-off station described above, a log moving roller 28 is provided at a second station in the superstructure of the trailer frame. More particularly, this second superstructure station includes a carriage 26 that is slidably mounted in the frame superstructure 32 by a vertically oriented actuator or cylinder 34. The movable end of the actuator is connected to the carriage 26 for moving the roller up or down. It is a feature of the invention that the roller 28 be continuously biased downwardly both by its own weight and by the hydraulic actuator 34 during operation of the driven roller 28. The downwardly biased roller 28 functions to feed the log forward and clamp the log during the cutting process. The roller 28 is rotatably supported in the carriage, and includes teeth or other suitable log engaging elements to allow the driven roller to move the log L longitudinally from right to left in a downstream direction. A hydraulic motor $M_2$ rotates this log advancing roller which is controlled by the operator. The operator advances the log a predetermined distance and then initiates the operation of the cut-off saw as described previously. A flexible guide rod may be mounted a known distance from the cutting plane of the saw which is equal to the desired log length to provide a visual indication of the length of log to be cut.

Finally, the trailer frame includes elongated ways 30, 30 for slidably supporting the log during its movement in this downstream direction. These ways are best shown in FIG. 2 as inclined flanges provided at the marginal facing edges of and are formed as part of the trailer frame itself.

In summary the above-identified apparatus can be transported to a remote site and operated from a single gasoline or diesel engine which in turn operates a hydraulic pump in panel P for selective operation of the motors $M_1$, $M_2$ for driving both the cut-off saw and the driven roller for moving the log in a downstream direction on the trailer. The hydraulic actuator cylinders 19 and 34 operate the ram 18 and the carriage 26.

Other variations of the apparatus will occur to those skilled in the art, and it is important to note that the capabilities of the apparatus are enhanced by the low maintenance required in view of the relatively small number of movable parts. The operator may operate each of those hydraulic motors and actuators in sequence, or under the control of a system (not disclosed) since each mechanism has its own independent drive motor or actuator. The operator can operate these two mechanisms in sequence followed by the splitting of the logs at the log splitting station.

Other variations of this apparatus will occur to those skilled in the art. For example, in the handling of relatively large logs it may be desirable to include a driven chain 36 having log engaging elements between the ways 30, 30 so as to assist in the transport of relatively large logs in the manner described. Such a chain might be driven concurrently with the operation of the driven roller 28.

Still another variation would be to provide two canted rollers in place of the single horizontally oriented roller 28 for driving the log in the downstream direction. However, such a mechanism would necessarily be more complex than that shown, and hence less desirable in a portable apparatus of the type described herein which is also designed for its minimum maintenance requirements.

The driven roller 28 may be powered by a motor arranged coaxially with the roller itself, but preferably the motor $M_2$ is offset and the roller driven through a chain and sprocket arrangement.

Although the hydraulic cylinder provided in the superstructure S may be used to bias the carriage 26 and hence the driven roller 28 downwardly against the log L it will be apparent that gravity and the weight of the carriage and pressure roller itself might be relied upon for this purpose. Other biasing means might be also utilized in addition to gravity and hydraulic pressure as for example springs might be provided for this purpose.

The provision for ways slidably supporting the log on the trailer might be enhanced by the use of non-driven rollers provided at spaced locations on the trailer. However, such dead rollers are deemed less satisfactory than the fixed ways from the point of view of ease in maintaining the apparatus and utilizing it at remote locations.

The driven roller 28 is preferably a single roller arranged for rotation on a horizontal axis and has an hourglass shape with individual spikes or teeth provided in its periphery. Sharpened strips running the length of the roller might also be utilized. In the event that canted rollers were to be provided, such a design could facilitate the use of rubber tires with or without chains on these tires in place of the single driven roller shown.

An advantage of the driven roller 28 is its continuous engagement with the top surface of the log. This enables the wood processor to handle logs that are not straight and do not lay flush between the ways to engage the driven chain 36 therebetween. Furthermore, the driven roller provides the dual function of pulling the log along the ways 30, 30 and of clamping the logs during the cutting process.

I claim:

1. Apparatus for processing logs comprising:

elongated log supporting ways for slidably supporting a log for movement in a downstream direction;

a driven cut-off blade movable in a radial plane relative said downstream direction for cutting off a selected length of the log;

a driven roller provided above said ways and oriented transversely to said downstream, said driven roller disposed adjacent to and upstream from said cut-off blade;

an actuator for moving said driven roller toward and away from said ways for engaging the upper surface of the log to move the log longitudinally in the downstream direction and clamp the log during cutting; and a log splitting station downstream of said cut-off blade, said log splitting station including a driven ram provided immediately below said ways, and a fixed wedge against which a log to be split is driven by said ram after dropping into said log splitting station.

2. The apparatus of claim 1, wherein said driven roller is driven by a motor.

3. The apparatus of claim 1, further comprising a plurality of non-driven rollers provided between said ways oriented perpendicular to said downstream direction, said non-driven rollers engaging the lower surface of the log to move the log longitudinally in the downstream direction.

4. The apparatus of claim 1, wherein said ways include a pair of inclined flanges for receiving and guiding the log.

5. The apparatus of claim 1, wherein said driven roller comprises a pair of canted driven rollers.

6. The apparatus of claim 1, wherein said driven roller comprises a single horizontally extending hourglass shape roller with log engaging elements provided in its periphery.

7. The apparatus of claim 1, wherein said driven cut-off blade comprises a pivotably mounted chainsaw oriented for movement in a radial pal driven by a first motor.

8. The apparatus of claim 1, further including a fixed frame which is supported on a least two wheels, and wherein at least one movable foot is provided in said trailer frame to raise or lower the fixed frame about the axis of said wheels.

9. The apparatus of claim 1, further including a drive means for engaging the lower surface of the log to move the log longitudinally in the downstream direction, said drive means provided between said ways and oriented parallel to said downstream direction.

10. The apparatus of claim 9 wherein, said drive means includes a driven chain having log engaging elements.

* * * * *